United States Patent [19]

Gibeault

[11] 3,935,824

[45] Feb. 3, 1976

[54] METHOD AND MEANS OF COMBUSTION

[76] Inventor: Robert E. Gibeault, Manor Drive, Glens Falls, N.Y. 12801

[22] Filed: Oct. 16, 1974

[21] Appl. No.: 515,232

[52] U.S. Cl. ..... 110/8 C; 110/8 A; 110/49 R

[51] Int. Cl.[2] ..... F23G 5/12

[58] Field of Search ..... 110/8 R, 8 C, 8 A, 18 R, 110/18 C, 49 R

[56] References Cited

UNITED STATES PATENTS

| | | | |
|---|---|---|---|
| 1,679,909 | 8/1928 | Michael et al. | 110/49 |
| 3,485,191 | 12/1969 | Christman | 8/49 |
| 3,538,865 | 11/1970 | Lausmann | 8/49 |
| 3,749,031 | 7/1973 | Burden, Jr. | 110/49 X |
| 3,777,679 | 12/1973 | Przewalski | 110/8 |
| 3,815,523 | 6/1974 | Gibeault | 110/8 |
| R24,844 | 7/1960 | Bouchard | 110/8 |

*Primary Examiner*—Kenneth W. Sprague

[57] ABSTRACT

Disclosed is a method of combusting hydrocarbon containing materials and equipment suitable for practicing the method in which the materials are burned in a closed chamber at a temperature significantly above the autogenous ignition temperature of the hydrocarbons and the resulting gases exhausted to a separation and classification chamber where additional oxygen is admitted to the high temperature gases to create a secondary combustion zone in the classification chamber. The light hydrocarbon and particulate free gases are allowed to escape from this chamber by thermal convection through a barometrically dampered exhaust stack. All other gases are mechanically induced to return or recycle to the combustion chamber and to enter it at a temperature at least as high as the autogenous ignition temperature of the hydrocarbons. The entire system is operated at a negative pressure and air is admitted to the system only as a result of the pressure differential maintained between the system and the external atmosphere.

The port through which the gases exhaust from the combustion chamber to the classification chamber is a venturi and the zone between this venturi and the separation and classification chamber is a zone of reduced pressure. Pressure is further reduced in this zone by withdrawing some of the gases therein through a by-pass to a fan unit which injects them into the gases recycling to the combustion chamber.

30 Claims, 11 Drawing Figures

METHOD AND MEANS OF COMBUSTION

FIELD OF THE INVENTION

This invention relates to a method of removing hydrocarbons by burning and/or of removing non-combustible particulate matter from discharged gases and to equipment capable of performing the method. The method combines both burning and recycling and may or may not use conventional fuel such as natural gas or heating oil as part of its thermal energy input. The method provides a way of disposing of waste materials without pollution and, in many cases, with an output of usable thermal energy. The invention is capable of pollutant suppression in a wide range of uses from burning high b.t.u. content hydrocarbons to removal of dust particles from industrial waste gases. The invention both provides sufficiently complete combustion to eliminate discharge of hydrocarbon material and also separates out and, thus, removes particulate irrespective of whether or not it is combustible.

DESCRIPTION OF THE PRIOR ART

This invention is an improvement over my invention described in U.S. Pat. No. 3,815,523 entitled INCINERATOR issued June 11, 1974. The invention disclosed in that Patent operates with a positively pressurized combustion chamber. The system described in that Patent works well but this invention is a significant improvement in that it greatly increases the range and types of materials which the equipment can handle without emitting pollutants.

It has been accepted practice in combustion processes to supply large quantities of air to the combustion chamber either by forcing air into the chamber under pressure or pulling it into the combustion chamber by positively withdrawing gases from the chamber. Either system results in both excess oxygen and in strong, particle entraining currents in the combustion chamber. In both arrangements, the rate of combustion is difficult to regulate and can only be regulated within ranges which are unacceptable, if a significant or acceptable degree of emission control is to be exercised. Further, the use of the excess oxygen system requires the exercise of careful control over the type of material entering the combustion chamber because, in many cases, sufficient oxygen is present to support a violent reaction or at least an undesirably rapid increase in the combustion rate. Some systems have attempted to overcome these problems with the so-called "starved air" system. This arrangement attempts to control the combustion rate by maintaining an oxygen supply only slightly more than that theoretically necessary to react all the available hydrocarbon material. This system also is unsatisfactory because it not only delays and prolongs the combustion process but is a source of substantial quantities of pollutants resulting from unreacted or partially reacted hydrocarbons.

Further, neither system is particularly adaptable to recycling. The positive pressure system tends to force the exhaust gases to by-pass the recycling system before they have been stripped of pollutants. The "starved air" system fails to adequately react all the hydrocarbons. Therefore, the purpose of recycling is substantially frustrated because there is an absence of pollutant free gases to release.

SUMMARY OF THE INVENTION

I have discovered that by operating the combustion chamber at a small negative pressure and by combining this with my recycling method, that the burning of hydrocarbons over a wide range of b.t.u. content and rate of input can be accomplished without producing unacceptable emission of pollutants. This system contemplates the use of only sufficient air to completely react the available hydrocarbon and accomplishes this by repeatedly recycling the heated gases at temperatures substantially above that at which auto-ignition of hydrocarbons occurs until the reaction is complete. This discovery is important because it makes it possible to perform effectively a number of emission suppression functions without necessitating more than a general classification of the b.t.u. content of the material being fed to the equipment. Among other advantages, it permits the equipment, under normal usage conditions, to be self-regulating with only a minimal number and complexity of controls. In fact, the conditions of usage of this invention may vary significantly beyond that considered feasible for existing equipment even though such existing equipment is not intended nor is its usage such that it is capable of attaining emission control in the range of the present invention.

I have not yet been able to actually determine to my own satisfaction exactly how my invention operates. However, I theorize that by recycling to the combustion chamber a substantial portion of its gaseous discharge including all or almost all of the gases containing unoxidized hydrocarbons at temperatures within a predetermined range and substantially above that at which hydrocarbons autogenically oxidize, I have created a condition in which only that much oxygen will be admitted to the system as the chemical reaction within it demands to maintain the reaction within the predetermined thermal range and, thus, only that required to maintain a reasonably uniform rate of oxidation.

In this system, the rate of discharge to the atmosphere is responsive only to the capability of the stack using thermally induced draft, limited by a barometric damper, to withdraw gases from the system. At the same time, functionally isolated from the stack by a venturi and a recirculating fan, the combustion chamber either has to extinguish its combustion from lack of oxygen or to draw oxygen from the outside atmosphere. Since a certain quantity of heated, particulate free nitrogen and carbon dioxide is always accumulating in the separation chamber and exiting via the stack a certain amount of atmospheric gases will be drawn into this system to keep the system volumetrically balanced. This is believed to be a major factor in making the system volumetrically negative throughout and isolating the effects of the exhaust stack from the air intakes of the combustion chamber. Thus, the major influencing factor in the combustion chamber is the recirculating fan reducing the influence of the exhaust stack to that which is incapable of withdrawing particulate laden material and at the other end of the spectrum reducing variations in the oxygen entry capability to the extent that major variations in combustion rates are not possible. The result is a system which, once its operation is initiated within a certain temperature range, is capable of regulating its combustion rate despite variations in the type and quantity of hydrocarbons entering the combustion chamber. Thus, it is capable of maintaining total combustion at all times, eliminating emission of unreacted hydrocarbons.

DESCRIPTION OF THE PREFERRED EMBODIMENT

Figure 8:
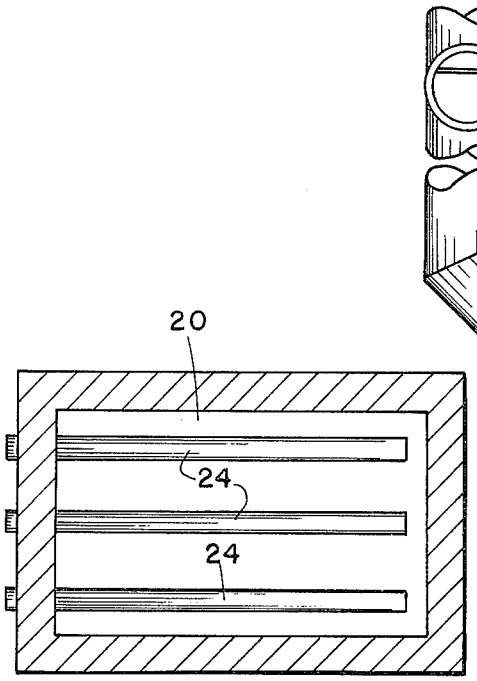
FIG. 8 is a fragmentary sectional view illustrating a screw-type feeder.
Figure 1:
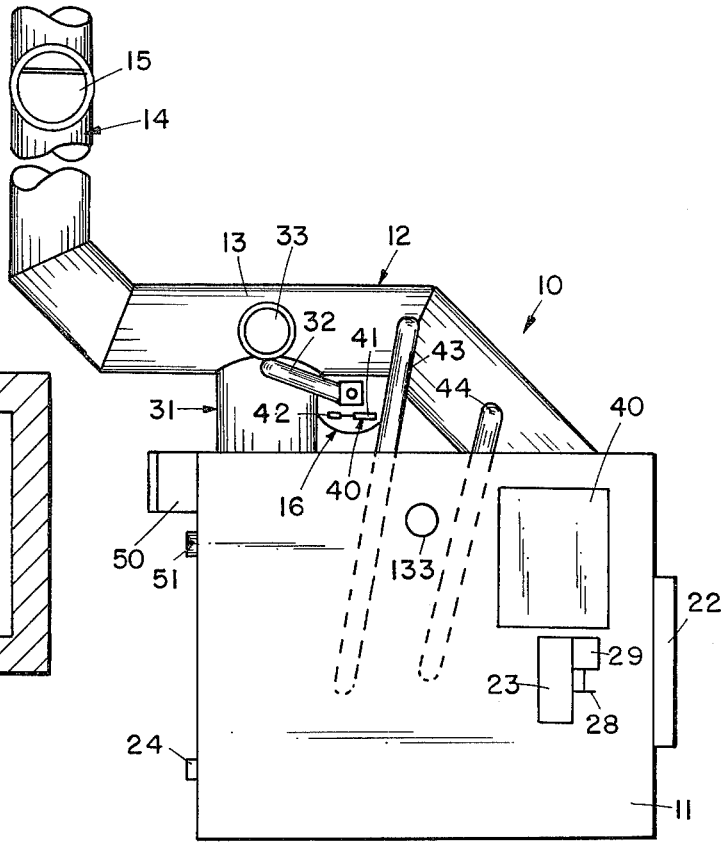
FIG. 1 is a side elevation view of equipment incorporating my invention and capable of executing the objectives of my method.
Figure 4:
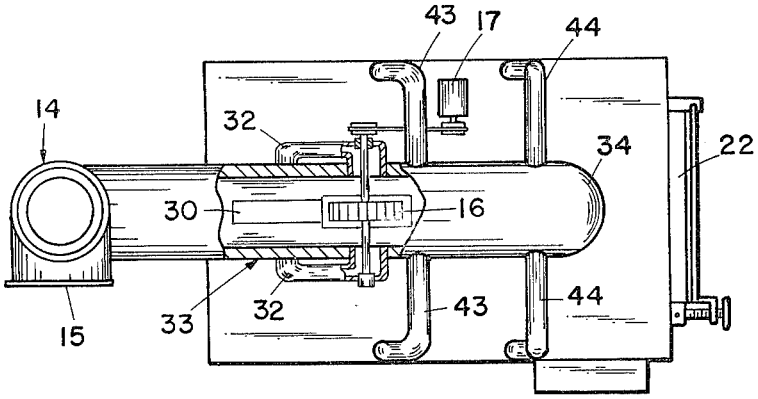
FIG. 4 is a partially broken plan view of my invention.

Referring now to FIG. 1 of the drawings, numeral 10 refers to the combined combustion, recycling and separation/classification unit having a combustion section 11, a recycling section 12 which is connected to a separation/classification section 13 exhausting through a stack 14 controlled by a barometric damper 15. The recycling section 12 includes a paddle-type fan 16 driven by a motor 17 (FIG. 4). All of the structure described above is disclosed in U.S. Pat. No. 3,815,523 entitled INCINERATOR, issued June 11, 1974.

Figure 3:
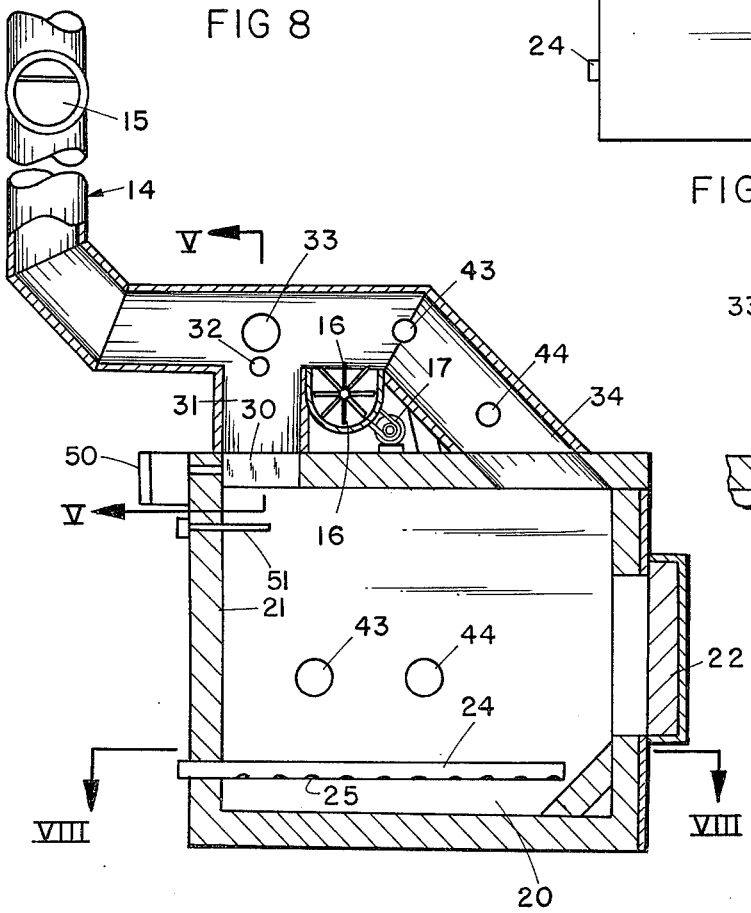
FIG. 3 is a sectional elevation view taken along the plane III—III of FIG. 2.
Figure 5:
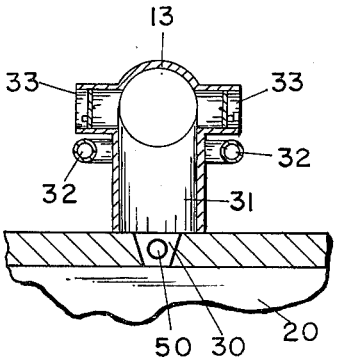
FIG. 5 is a fragmentary, sectional, elevation view taken along the plane V—V of FIG. 3.

The combustion section 11 has a combustion chamber 20. As better seen in FIG. 3, it consists of a generally rectangular chamber, the walls and floors of which are lined with material resistant to high temperatures such as fire brick 21. In the form of the invention illustrated in FIG. 3, the material to be burned is introduced to the combustion chamber through the insulated door 22. In the case of certain types of uses, a primary burner 23 (FIGS. 1, 2 and 4) is provided for the purpose of initiating combustion of the materials placed in the combustion chamber 20. The combustion chamber also has air intake tubes 24, equipped with suitable exhaust ports 25 (FIG. 3). The number and size of the air intake tubes 24 will depend to some extent on the particular application of the invention such as the difference in b.t.u. input between scrap rubber tires and packed, wet newspapers. These will be discussed in greater detail subsequently.

Except for the door 22, the primary burner 23 and the air intake tubes 24, the combustion chamber 20 is sealed from the exterior atmosphere. The primary burner 23 is equipped with a closure 28 which seals the burner's air intake when it is not operating. The closure 28 can be operated by any suitable means such as a solenoid 29. The importance of this will be made clear subsequently.

Mounted on top of the combustion chamber is the recycling section 12. The sole exhaust for the combustion chamber 20 is through a restricted orifice 30, creating a venturi into a vertically extending expansion section 31 which discharges into a re-burning, separation and classification section 13. In this section, it is subjected to three separately operating forces.

Figure 2:
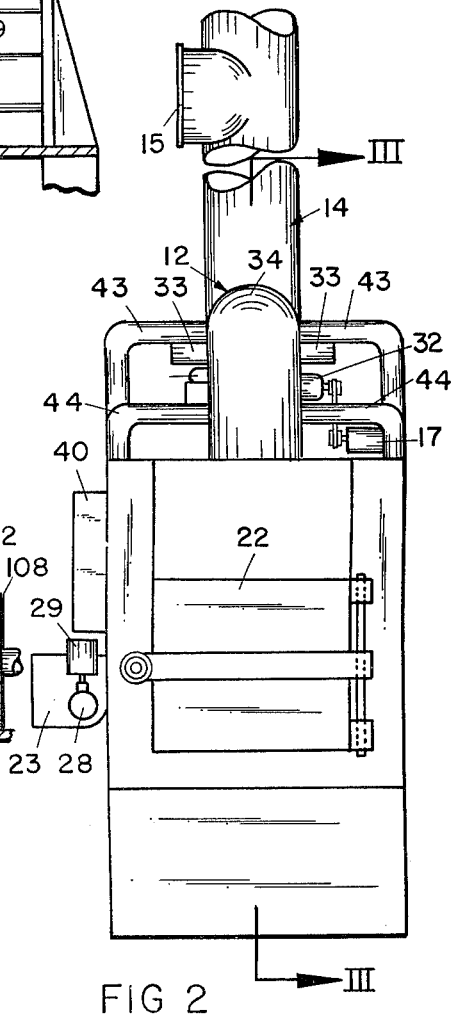
FIG. 2 is a front elevational view of the equipment illustrated in FIG. 1.

The first of these forces is that created by the by-pass or static supply conduits 32, one on each side of the separation chamber (FIG. 2). The by-pass conduits 32 preferably communicate with the separation or classification chamber 13 just below the air intakes 33. They may connect to this section at a lower point but preferably not below the bottom of the horizontal section of the recycling section. The by-pass conduits 32 provide a sufficient supply of discharge gases to the fan 16 to assure its effectiveness as a recycling fan. The other effect of the by-pass conduits will be discussed in detail subsequently.

The second of these forces is the result of the fan 16 pulling gases forward into the main return duct 34. The third force is that created by the exhaust stack 14, the gas flow through which is regulated by the barometric damper 15. Preferably, the entire recycling section 12, including the expansion section 31, the classification section 13, the return duct 34 and the stack 14 is thermally insulated to conserve the thermal energy of the recycled gases.

On one side, the fan 16 has an outside air intake 40 regulated by a gate 41 (FIG. 1). This air intake supplies a very minor portion of the overall oxygen requirement of the equipment. In fact, its purpose is that of a micro-controllable means of precisely regulating the operation of the equipment. Preferably, the gate is operated by a servo-motor 42.

The fan 16 is largely enclosed in its housing 39 with only a small portion of the fan projecting into the recycling chamber (FIG. 3). It is important that the fan be capable only of inducing a gas flow in the recycling chamber but not of producing a high velocity air stream.

A pair of return gas distribution tubes 43 and 44 are provided on each side. The intake ends of these tubes communicate with the return duct 34 and the discharge ends open through the sides of the combustion chamber. The tubes 43 and 44 serve the purpose of distributing the hot, recycled gases in the combustion chamber for a more uniform combustion pattern. As the tubes 43 and 44 extend down the sides of the combustion chamber they are embedded in the thermal insulation to conserve thermal energy. While the upper portions of these tubes are not illustrated as being thermally insulated, this can be done to still further conserve thermal energy.

An external source of thermal energy in the form of a gas or oil fired booster burner 50 is provided. The burner 50 is mounted to fire into or just below the venturi throat 30. Assuming sufficient hydrocarbon materials are present in the combustion chamber, the burner 50 is used only on start-up to bring the temperature of the recycling gases up to the equipment's normal operating range or subsequently, due to the lack of sufficient hydrocarbon or the presence of a thermally depressant factor such as excessive moisture, for example. In this latter case, its operation is usually temporary. The burner 50 does not operate as an afterburner, it operates as a thermal regulator. When it is used during initial start-up, it may or may not be used in conjunction with burner 23.

The operation of the burner 50 is controlled by the pyrometer 51 which is positioned to sense the thermal level of gases as they leave the combustion chamber.

The mechanical feed mechanism for the unit can take many forms. It can be intermittent or continuous.

It is important, however, that it be capable of restricting the amount of oxygen entering the combustion chamber with the charge.

Figure 9:
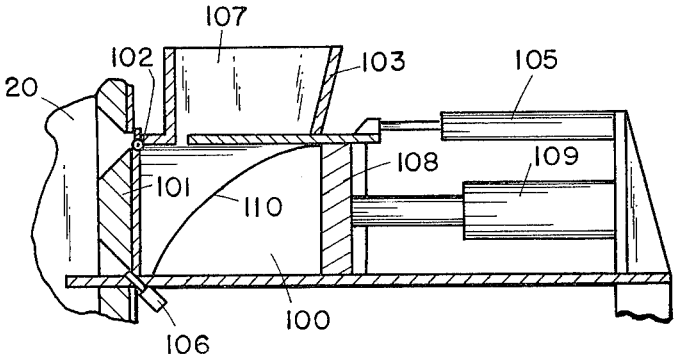
FIG. 9 is a fragmentary sectional view of a ram-type feeder for this invention.

FIG. 9 illustrates an intermittent type feeder. A charging chamber 100 is separated from the combustion chamber 20 by an insulated door 101 pivotally mounted for inward and upward pivotal movement by the upper edge hinge 102. It will be recognized that a power operated door could be substituted which may move vertically or horizontally to open and close the charging port for the combustion chamber 20. The top of the chamber 100 communicates with a hopper 103 and can be closed off from the hopper by a sliding gate 104 operated by a reciprocating cylinder 105.

With the door 101 closed and locked by the latch 106, the sliding gate 104 is withdrawn and the contents of the hopper 103 is charged into it, preferably with sufficient force to substantially pack it as by means of a press, schematically illustrated at 107. This arrangement largely fills the chamber 101 and, when the gate 104 is closed, an insignificant quantity of oxygen remains in chamber 101. The ram 108 is then operated by actuation of the reciprocating cylinder 109 to force the contents of the charging chamber 101 into the combustion chamber 20. As an added precaution against jamming of the ram 108 and door 101 in the event a partial charge only exists in the charging chamber the sides of the ram 108 may be equipped with cam 110 to positively pivot the door 101 open. It will be understood that the preceding description illustrates only one of the various possibilities for providing an oxygen restricted, intermittent feed for this invention.

Figure 7:
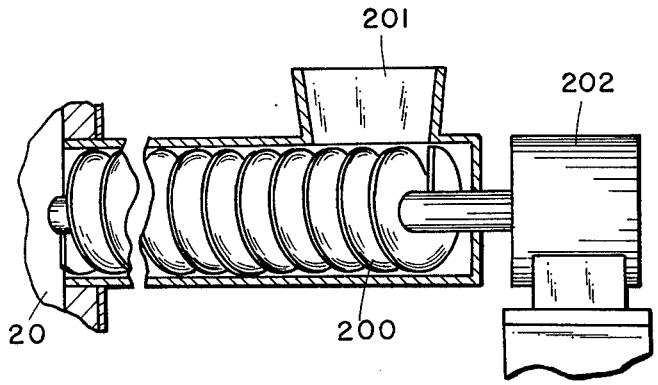
FIG. 7 is a fragmentary, sectional view taken along the same plane as FIG. 3, illustrating one method of ash removal.

FIG. 7 illustrates a different approach in which a screw conveyor 200 receives a continuous charge of combustible material such as trash from a hopper 201 and pushes it into the combustion chamber 20. The screw conveyor 200 is shown as directly driven by the motor 202 but it will be recognized that any other suitable power source, direct or indirect, may be used. The importance of this will become clear later. Again, the screw conveyor will compact the material and largely eliminate air, thus oxygen. Other types of continuous or intermittent feeds are usable with this invention provided they are capable of performing the functions outlined above within the functional requirements of the method and equipment herein disclosed.

Figure 6:
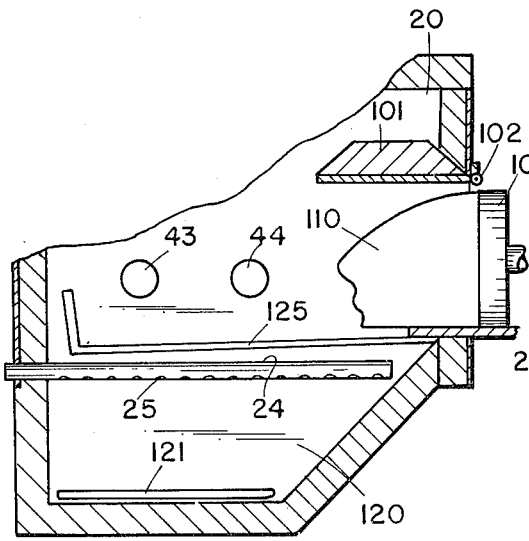
FIG. 6 is a sectional view taken along the plane VI—VI of FIG. 6.

FIG. 6 illustrates one possible means of handling the residue of this invention. Since the invention contemplates the total reduction of hydrocarbons, the only residue will be non-combustible minerals, i.e., ash, or non-hydrocarbons initially fed into the combustion chamber, such as tin cans, aluminum cans and the like. If the invention is being used as a burner for No. 2 type trash, the invention can be provided with an ash collection pit or chamber 120 beneath the inclined grate 125 in the combustion chamber 20. All of the incombustible residue of the incineration process would drop into this chamber, preferably into removable means 121 to permit it to be quickly emptied. An alternate possibility would be to provide a conveyor means at the bottom of the residue chamber 120 such as a screw conveyor to remove the residue either continuously or intermittently at suitable intervals. Because of the nature of the combustion process, the collection chamber 120 must remain closed during the combustion process to prevent entry of excess oxygen. Thus, whatever residue removal system is used must be capable of maintaining an air seal or must be capable of accumulating substantial quantities of residue to reduce the number of times the chamber must be opened.

Operation of the device is regulated by the control panel 140 which, in turn, responds to the readings of the pyrometer 51 which continuously monitors the temperatures of the gases in the combustion chamber at a point close to where they exit from the chamber.

The control panel 140 is preprogrammed to respond to temperature changes which depart outside a predetermined operating range. The control panel may also be programmed to respond to temperature changes which exceed a certain rate of change, particularly in the case of a temperature rise. The control panel in response to the input of the pyrometer 51 governs the operation of a number of devices which affect the functioning of the equipment (See FIG. 11). Among the functions it controls are the rate of feed of the combustible material to the combustion chamber, whether or not the primary burner 23 and the booster burner 50 operate. It also regulates the air intake 40 on the side of the fan 16. In addition, it is capable of actuating the emergency shut down dampers 150. The details of the control panel and its functions will be described more fully under the following section.

OPERATION

The combustion chamber 20 may initially be charged with the material to be incinerated or alternately it may first be heated to its operating temperature and then charged. The initial heating can be done by firing the booster burner 50 or, if the machine is equipped with a primary burner 23, it may be done by firing the primary burner. It is also possible to use both burners. As soon as operation of either of the burners is initiated, the recycling fan is started. If the combustion chamber is empty of any charge, the operation of the fan during preheat is important only to assure thorough heating of the recycling chamber. However, if any charge is present, operation of the fan is essential to assure recycling and suppression of release of unsatisfactory emissions through the stack 14.

The heating continues until the pyrometer 51 senses gas temperatures in the operating range of the equipment. For most types of operation this is 1050°F. to 1350°F. and preferably 1100°F. to 1300°F. This is well above the autogenous ignition temperature of 850°F. of even relatively incombustible hydrocarbons.

When the operating temperature is attained, the burners 23 or 50, as the case may be, are turned off and, preferably their air intake openings are closed. At this point, the equipment under normal conditions, is able to continue to burn No. 2 type trash, such as that collected by trash haulers in a normal metropolitan area, without further thermal input from either of the burners 23 or 50.

While the equipment can be unit charged and operated until the entire charge is entirely reduced to ashes, preferably, the unit is provided with means such as that illustrated in FIGS. 9 or 7 to intermittently charge additional material at regular intervals or to charge it continuously at a regulated rate of input. So long as the combustion chamber temperature remains within normal operating limits, the equipment will operate without change. However, should the rate at which the combustible material is fed to the combustion chamber be insufficient, this will slow the rate of combustion and the temperature will drop. When this is sensed by the pyrometer 51, the rate of input of the material will be increased. This normally should result in increased combustion and an accompanying rise in temperature. Should the drop in temperature continue, the booster burner 50 will be activated until the temperature is once again stabilized in the proper operating range.

Figure 11:
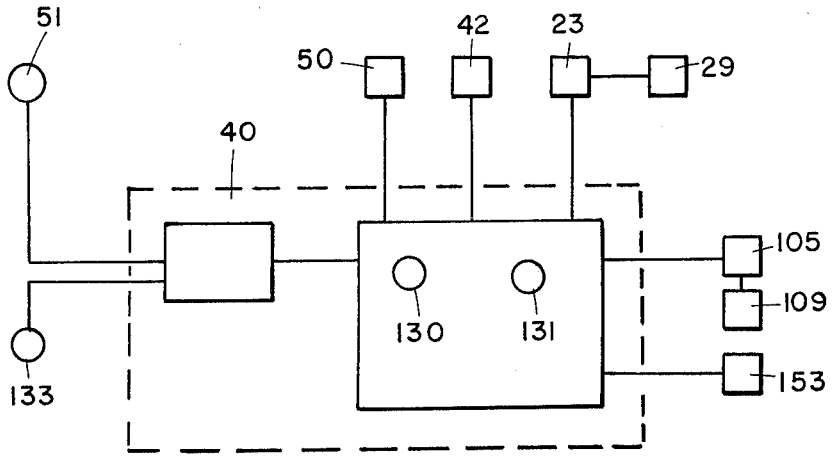
FIG. 11 is a schematic diagram of the control circuitry for this invention.
Figure 10:
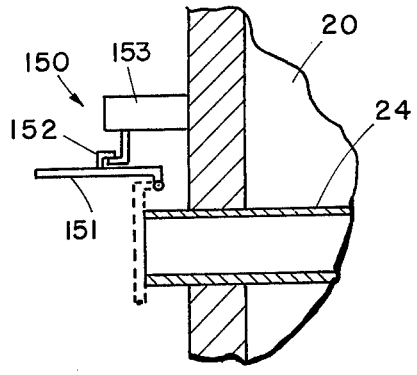
FIG. 10 is a fragmentary, enlarged view of closure for the air intake ports.

If the temperature rises above a certain level, the rate of material input will be decreased. If the rise continues or is excessively rapid, the unit may be shut down by closing the emergency dampers 150 at the intake end of the air supply tubes 24 (FIG. 10) — shutting off the oxygen supply. The emergency dampers 150 can be of various types such as a hinged closure member 151 normally held open by a latch 152 which, upon actuation of the solenoid 153, will close by gravity. Each duct 24 may be equipped with its own shut off or a single solenoid may control all of them as a unit. The control panel can also provide either or both a visual or an audible signal of either excessive or inadequate temperatures. Such signals are shown in FIG. 11 as a light 130 or buzzer 131.

Once the primary burner 23 is shut down, the combustion chamber 20 becomes pressure negative because the heated gases exhaust through the venturi 30 into the expansion chamber 31. Part of these gases are exhausted through the stack 14 and the rest recycled by the fan 16. Thus, there is a net reduction in gas volume within the system which is made up by inducing air to enter the system solely by pressure differential through the air ducts 24. The intake ends of the air ducts 24 are equipped with barometric dampers to prevent reverse flow and to insure intake of air only when the same results from an actual negative pressure condition in the combustion chamber. The emergency dampers 150 are so designed that they seat over these barometric dampers. In this manner, only that quantity of oxygen enters the system as is required to completely react all of the hydrocarbons present. Since there is complete combustion of the hydrocarbons, none remain to be exhausted from the stack. Further, since both the combustion chamber and the recycling chamber are at a slightly negative pressure and the stack 14 is equipped with a barometric damper 15, there are no gas currents of sufficient velocity to carry even very fine particulate material up the stack.

The by-pass ducts 32 further reduce the pressure in the expansion chamber 31. They also provide a positive supply of gases to the fan 16, assuring it of sufficient static to function properly. The pressure reduction serves to further improve separation and classification of the gases in the separation zone so that only those gases free of hydrocarbon and entrained particulates will drift toward the entry of the stack 14 and be exhausted. The secondary air intakes 33 create a high temperature reaction zone which serves to separate the material to be recycled from that to be discharged. Any hydrocarbons attempting to pass through this zone to the stack 14 will be reacted since they will come into contact with oxygen while heated well above their autogenous ignition temperature.

The air intake 40 is used to assure the fan 16 of a sufficient supply of gas that it will operate efficiently. If it does not do so, the rate of recycling will slow and the intake 40 will be slightly opened. If the system begins to approach a pressure equilibrium or neutral state, the air intake 40 will be closed sufficiently to restore the desired negative pressure condition. Thus, it serves as a delicate adjustment to maintain proper operating conditions. The pressure condition may be determined by sensor 133.

If the unit is used for treatment of liquid wastes, such as a mixture of oil and water, the mixture is atomized and sprayed into the combustion chamber. The atomization can be mechanical by use of very high pressures as by introduction with high pressure steam. Whether the process will require additional energy input will depend upon the available b.t.u. content of the waste material. Further, it is entirely possible to pass the liquid wastes in heat exchange with the exhaust gases of the unit, thus, materially reducing the energy required to raise the temperature of the liquid wastes to that necessary for burning its combustible constituents.

If the unit is used as a fume suppressor, the fumes are introduced into the combustion chamber. Again, whether additional thermal energy will be required will depend upon the b.t.u. content of the fumes. In the case of both the liquid wastes and the fumes, once the material has entered the combustion chamber, the process of total combustion, recycling and classification to eliminate emission of either hydrocarbons or particulate materials is the same as with the burning of solid waste materials.

The system conserves its thermal energy. This is done by enclosing both the combustion chamber and the recycling chamber in thermal insulation. Thus, the recycled gases re-entering the combustion chamber 20 from the recycling chamber 12 are only slightly below the temperature at which gases exhaust from the combustion chamber. Thus, very little thermal energy is utilized by these recycled gases and only a relatively small rate of combustion is necessary to maintain the unit's operation. This is very important in reducing and, in most cases eliminating, the need for added energy input. Thus, the invention not only effectively controls pollution but does so while materially reducing the energy requirements necessary to do so. In fact, in many situations, such as the burning of No. 2 type trash, instead of a large consumer of energy, it can be used as a large producer of available, high temperature, thermal energy by use of heat exchangers in the stack 14 where the exhaust gases are heated to about 600°F.

A system has been described which is capable of pollution free disposal of waste materials of a wide range of characteristics. In most cases, it can perform this function using far less energy than any system heretofore developed for the same purpose. Further, in many cases, it not only uses less energy, it becomes a producer of thermal energy which can be made available for a wide range of uses.

While I have described a preferred embodiment of my invention and a preferred method of pollution free combustion, it will be recognized that various modifications of my invention can be made without departing from the principles thereof. Such modifications as include the principles of my invention are to be included in the hereinafter appended claims unless these claims by their language expressly state otherwise.

The embodiments of the invention in which an exclusive property or privilege is claimed are defined as follows.

1. In a device for high temperature oxidation of hydrocarbons having a primary combustion chamber, a pair of spaced ports opening through the upper portion of said primary combustion chamber, a gas expansion chamber, one of said ports discharging gases from said combustion chamber into said expansion chamber, a tubular recycling chamber extending from said expansion chamber to said second port and a fan in said recycling chamber for inducing gases to return to said combustion chamber through said recycling chamber; a gas discharge stack communicating with said recycling chamber and said expansion chamber and extending from said expansion chamber oppositely from said recycling chamber, said device characterized in that a secondary combustion air intake port is provided at the juncture between said stack, recycling chamber and expansion chamber to provide a secondary combustion zone separating the gases entering said recycling chamber and those entering said stack.

2. A device for high temperature oxidation of hydrocarbons as described in claim 1 wherein a barometric damper is mounted in said intake port for regulating the rate of air intake.

3. A device as described in claim 2 wherein a pair of said intake ports are provided, said ports being aligned with each other, one on each side of the tubular structure forming said recycling chamber and stack.

4. A device as described in claim 1 wherein a gas by-pass conduit communicates on one end with said expansion chamber and on the other end with said fan.

5. A device as described in claim 4 wherein said by-pass conduit communicates with said expansion chamber between said one port of said combustion chamber and said combustion air intake.

6. A device as described in claim 5 wherein a pair of said by-pass conduits are provided, one on each side of said expansion chamber.

7. A device as described in claim 6 wherein said expansion chamber, recycling chamber and stack are surrounded by thermal insulation.

8. A recycling combustion device having a primary combustion chamber and an elongated secondary chamber, a first port connecting said primary and secondary chambers through which gases enter said secondary chamber from said primary chamber and a second port spaced from said first port through which gases return to said primary chamber from said secondary chamber and means urging gases to move through said secondary chamber from said first port to said second port, an exhaust stack connected to said secondary chamber adjacent said first port and extending therefrom oppositely from said fan, said device characterized in that a combustion air intake is provided at the junction of said stack and secondary chamber adjacent said first port to create a secondary combustion zone at said junction.

9. A recycling combustion device as described in claim 8 wherein a pair of said intake ports are provided, said ports being aligned with each other, one on each side of said secondary chamber, a barometric damper mounted in each of said intake ports.

10. A recycling combustion device as described in claim 9 wherein a gas by-pass conduit communicates on one end with said secondary chamber between said one port and said intake port, said conduit on its other end communicating with said gas urging means.

11. A recycling combustion device as described in claim 8 wherein said primary combustion chamber is sealed from the exterior atmosphere except for air supply inlet means adjacent the lower portion of said combustion chamber through which air flows into said chamber solely by reason of a differential in static pressure between the interior and exterior of said chamber.

12. A recycling combustion device as described in claim 11 wherein said air supply inlet means is equipped with barometric damper means.

13. A recycling combustion device as described in claim 8 wherein secondary return ducts are provided interconnecting said secondary chamber and the lower portion of said combustion chamber, said ducts being embedded in the insulated walls of said combustion chamber.

14. In a method of burning hydrocarbons while suppressisng emission of particulate materials, the steps which comprise placing a quantity of hydrocarbon material in a combustion chamber, heating said hydrocarbons and the gaseous contents of the combustion chamber to a temperature substantially above the autogenous ignition temperature thereof while discharging the heated gases from said chamber into a classification and separation chamber and therein by mechanical means inducing the particulate laden gases to separate from the lighter particulate free gases, returning the particulate laden gases to the combustion chamber and permitting the remaining gases to discharge to atmosphere through a barometric damper regulated stack, restricting the entry of atmospheric air to the combustion chamber to that which will flow into said chamber as a result of a negative pressure differential in the combustion chamber produced by the combustion process and the discharge of particulate free gases through said stack.

15. The method of burning hydrocarbons as described in claim 14 wherein a quantity of atmospheric air is introduced to the heated exhaust gases in the classification and separation chamber for creating a secondary combustion zone as said air mixes with the heated gases containing combustible substances discharged from said combustion chamber.

16. The method of burning hydrocarbons as described in claim 15 wherein the air is induced to enter said secondary combustion zone solely by the static pressure differential between said zone and the exterior atmosphere.

17. The method of burning hydrocarbons as described in claim 16 wherein the secondary combustion zone forms both a barrier between particulate laden gases and dischargeable particulate free gases and converts some of the particulate in the particular laden gases to dischargeable particulate and hydrocarbon free gases.

18. In the method of oxidizing hydrocarbons while suppressing emission of particulate materials, the steps which comprise: subjecting the hydrocarbons in a first confined chamber under subatmospheric pressure and restricted oxygen supply to temperatures substantially above that at which they will automatically react with oxygen, discharging the heated gases from the first confined chamber to a second confined chamber and in the second chamber admitting from the exterior additional oxygen to the heated exhaust gases by pressure differential induction to create a secondary combustion zone, using said secondary combustion zone to separate particulate free gases from particulate laden gases, permitting the particulate free gases to escape to atmosphere and forcibly inducing the particulate laden gases to return to the first chamber.

19. The method of oxidizing hydrocarbons as described in claim 18 wherein the escape of particulate free gases is at a velocity no greater than that at which heated gases will move through a stack controlled by a barometric damper.

20. A method of burning hydrocarbon materials having either a uniform or non-uniform b.t.u. content per unit of volume comprising the steps of confining the hydrocarbon materials in a combustion chamber and igniting the hydrocarbon exhausting gases from the chamber through a venturi to a separation chamber to produce a reduction in volumetric gaseous content of the combustion chamber thereby creating a pressure therein less than that of the atmosphere surrounding the chamber, and in said separation chamber subjecting all but a small quantity of the lightest gases to a force returning them to the combustion chamber; discharging the light gases from the separation chamber only when the forces of thermal convection are sufficient to cause them to flow horizontally to a barometrically dampered stack against the resistance of exterior atmospheric pressure; admitting air through a restricted port to the combustion chamber only in response to the differential in gas pressure between the interior and exterior of the combustion chamber.

21. The method of burning hydrocarbon materials having either a uniform or non-uniform b.t.u. content per unit of volume to produce a gaseous discharge substantially free of hydrocarbons or particulate material comprising the steps of introducing the hydrocarbon material to a combustion chamber; maintaining the temperature of the gaseous content of the material above the ignition temperature of every type of hydrocarbon to be introduced into the combustion chamber; maintaining the gas pressure in the combustion chamber less than that of the outside atmosphere; withdrawing the gases from the combustion chamber through a restricted orifice into a chamber of further reduced pressure, separating the lighter gases from the heavier gases and entrained particulates and inducing both of the latter to return to the combustion chamber, allowing the lighter gases to escape by convection first horizontally, then vertically through a barometrically dampered stack only when the convection is sufficient to overcome the opposing forces of exterior atmospheric pressure and negative internal pressure; admitting air to the combustion chamber through a restricted orifice only in response to the differential in gas pressure between the inside and outside of said combustion chamber.

22. In combustion gas recycling equipment having interconnected combustion and combination gas separation and recycling chambers, the method of burning hydrocarbon material comprising the steps of maintaining the combustion and the combination gas separation and recycling chambers at a pressure less than that of the exterior atmosphere and admitting outside air to the combustion chamber only in response to said pressure differential and permitting gases to exhaust from the equipment only by flow initially in a horizontal path by thermal convection which is capable of overcoming resistance to such flow resulting from a subatmospheric pressure in the separation chamber and atmospheric pressure at the point of discharging into the atmosphere urging gases in said separation chamber to recycle to said combustion chamber.

23. In the method of burning hydrocarbon materials described in claim 22 wherein the number of cubic feet of heated gas exhausting from the equipment is the same as the number of cubic feet of atmospheric temperature gas entering the combustion department.

24. In the method of burning hydrocarbon materials described in claim 22 wherein additional oxygen is admitted to the gas separation chamber to create a secondary combustion reaction, said oxygen entering at a flow rate resulting only from the static pressure differential existing between said separation chamber and the exterior atmosphere.

25. In the method of burning hydrocarbon materials described in claim 22 wherein additional oxygen is admitted to the recycled gases before they re-enter the combustion chamber; regulating the rate at which oxygen is admitted to said recycled gases to maintain the pressure differential in said combustion chamber within a predetermined range.

26. In the method of burning hydrocarbon materials described in claim 22 wherein the temperature of the gases in said combustion chamber is in the range of 1050°F. to 1350°F.

27. In the method of burning hydrocarbon materials described in claim 22 wherein the temperature of the gases in said combustion chamber is in the range of 1100°F. to 1300°F.

28. In the method of burning hydrocarbon materials described in claim 22 wherein the temperature of the recycled gases entering the combustion chamber is at least that of the autogenous ignition temperature of the hydrocarbon materials.

29. A recycling combustion device comprising a combustion chamber, a gas recycling chamber, said recycling chamber having spaced inlet and discharge ports communicating with said combustion chamber and means for urging gases entering said recycling chamber to return to said combustion chamber, a gas exhaust stack communicating with said recycling chamber adjacent said inlet port and extending therefrom in a direction away from said discharge port, said combustion and recycling chambers being substantially sealed from the entry of exterior air except for an air intake port opening into the lower portion of said combustion chamber and an air intake port opening into the recycling chamber adjacent the inlet port and at the juncture of said recycling chamber and exhaust stack; said inlet ports being closed by barometric dampers whereby both of said chambers have a negative static pressure.

30. A recycling combustion device as described in claim 29 wherein an additional air intake means is provided communicating with said gas urging means; a movable closure member on said air intake means and an actuator element connected to said closure member and responsive to the static pressure within said combustion chamber for opening and closing said air intake means to maintain said negative static pressure condition.

* * * * *

UNITED STATES PATENT OFFICE

CERTIFICATE OF CORRECTION

Patent No. 3,935,824 Dated February 3, 1976

Inventor(s) Robert E. Gibeault

It is certified that error appears in the above-identified patent and that said Letters Patent are hereby corrected as shown below:

Col. 2, line 47, "from" should read --for--.
Col. 5, line 8, no paragraph after "continuous.".
Claim 14, lines 15 and 16, "suppressisng" should read --suppressing--.

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*